US008073187B2

(12) United States Patent
Hashimoto et al.

(10) Patent No.: US 8,073,187 B2
(45) Date of Patent: Dec. 6, 2011

(54) SPEAKER AND SPEAKER APPARATUS

(75) Inventors: Seiichi Hashimoto, Hamamatsu (JP); Junichi Fujimori, Hamamatsu (JP)

(73) Assignee: Yamaha Corporation (JP)

( * ) Notice: Subject to any disclaimer, the term of this patent is extended or adjusted under 35 U.S.C. 154(b) by 802 days.

(21) Appl. No.: 12/180,000

(22) Filed: Jul. 25, 2008

(65) Prior Publication Data

US 2009/0028374 A1 Jan. 29, 2009

(30) Foreign Application Priority Data

Jul. 26, 2007 (JP) ..... 2007-194266

(51) Int. Cl.
*H04R 1/02* (2006.01)

(52) U.S. Cl. ..... 381/401; 381/412

(58) Field of Classification Search ..... 381/401–403, 381/407, 412

See application file for complete search history.

(56) References Cited

U.S. PATENT DOCUMENTS

| | | | | |
|---|---|---|---|---|
| 5,408,533 | A * | 4/1995 | Reiffin | 381/96 |
| 5,828,767 | A | 10/1998 | Button | |
| 7,142,685 | B2 * | 11/2006 | Barnes | 381/396 |

FOREIGN PATENT DOCUMENTS

| | | | |
|---|---|---|---|
| GB | 2029669 | A | 3/1980 |
| JP | 11-164394 | A | 6/1999 |
| JP | 2001-186589 | A | 7/2001 |

OTHER PUBLICATIONS

Lemarquand, Guy; "New Structure of Loudspeaker"; Audio Engineering Society Convention Paper 6846, presented at the 120th Convention; May 20-23, 2006; pp. 1-4; Paris France. Cited in specification.

* cited by examiner

*Primary Examiner* — Richard A. Booth
(74) *Attorney, Agent, or Firm* — Rossi, Kimms & McDowell LLP

(57) ABSTRACT

A speaker capable of properly adjusting a spring characteristic with which a voice coil is driven and capable of being driven in large amplitude. When a position control coil wound around a bobbin is at a reference position, both ends of the coil cross a magnetic gap formed between external and internal yokes by a predetermined length and Lorentz forces acting on the front and rear ends are balanced. When the voice coil moves in either forward or rearward direction, lengths of the magnetic gap crossed by the front and rear ends of the control coil are different therebetween, and the vector sum of Lorentz forces acting on the position control coil is opposite in direction from the movement of the voice coil, whereby the voice coil is stably held at the reference position.

7 Claims, 8 Drawing Sheets

SPEAKER AND SPEAKER APPARATUS

This application is based on, and claims priority from, Japanese Patent Application No. 2007-194266, filed on Jul. 26, 2007. The disclosure of the priority application, in its entirety, including the drawings, claims, and the specification thereof, is incorporated herein by reference.

BACKGROUND OF THE INVENTION

1. Field of the Invention

The present invention relates to a speaker and a speaker apparatus.

2. Description of the Related Art

Electrodynamic, electrostatic, piezoelectric, electromagnetic and other types of speakers are conventionally known. Electrodynamic speakers (dynamic speakers), which are classified into a moving-coil type, a ribbon type, a Blatthaller type, a Heil type, etc. in terms of the construction of diaphragm and vibration source, are mainstream speakers since they are basically designed to drive a diaphragm by an electromagnetic force and achieve a high conversion efficiency with a relatively simple construction. A large majority of electrodynamic speakers are of moving-coil type such as a cone speaker and a dome speaker.

As shown in FIG. 16, the cone speaker includes a conical diaphragm (cone diaphragm C), a voice coil Vc and a magnetic circuit Mc that generate an electromagnetic force for driving the cone diaphragm C, a damper D that holds the voice coil Vc at a constant position relative to a gap Gp in the magnetic circuit Mc, an edge E that supports the periphery of the cone diaphragm C coupled to a tip end of the voice coil Vc, and a frame F that couples the above component parts into one piece.

To drive the cone diaphragm C, an electric current is caused to flow through the voice coil Vc disposed in the gap of the magnetic circuit Mc in accordance with an audio waveform, whereby the voice coil Vc directly coupled to the cone diaphragm C is reciprocated in a direction perpendicular to the line of magnetic force.

In the cone speaker, the damper D and the edge E serve to hold the voice coil Vc at the center of vibration. When using such a mechanical spring construction to hold the voice coil at the vibration center, the vibration of diaphragm C largely depends on the mechanical characteristic of the mechanical spring construction. Thus, a frequency-dependent variation is caused in sound emission, posing a problem. Another problem is that there is a limit in increasing the amplitude of vibration of diaphragm C.

To eliminate the problems of the mechanical support construction, the below-mentioned techniques have been proposed.

A method for solving the problems by using an air damper instead of the mechanical support construction is disclosed in the following document.

Guy Lemarquand "New structure of loudspeaker", Audio Engineering Society Convention Paper 6846 presented at the 120th Convention, May 2006

Another technique is disclosed in Japanese Laid-open Patent Publication No. 2001-186589, in which a bias current is added to an audio signal-based driving current for each coil of a double coil construction for adjustment of the vibration reference position.

Still another technical art disclosed in Japanese Laid-open Patent Publication No. 11-164394 includes a braking coil for exerting a braking force on the voice coils, the braking coil being disposed outside magnetic fields when the voice coils are each at a stationary position. In this technique, the vibration reference position is adjusted by a conventional mechanical structure.

In the technique disclosed in the document entitled "New structure of loudspeaker", the mechanical characteristic corresponding to a spring constant is determined by the air damper structure, thus posing a problem that the degree of freedom of design is limited. In addition, an air chamber is required, which is large in volume in comparison with its diameter.

In the technique disclosed in Japanese Laid-open Patent Publication No. 2001-186589, an audio signal is supplied to the coils for being held in the vibration center position. When the coils are each at a position other than the vibration center position, these coils are deviated from a magnetic gap region, posing a problem that the efficiency of utilizing the magnetic field is lowered. Other problems are that the coils must be applied with biases which are opposite in polarity, resulting in a complicated driving circuit, and these coils are difficult to be utilized for any purpose (such as a motion feedback sensor) other than intended one.

In the technique disclosed in Japanese Laid-open Patent Publication No. 11-164394, when the voice coils are at vibration center positions, the braking coil must be positioned at a position deviated from the magnetic field. In such a state, a Lorentz force for realizing a damperless structure cannot be obtained.

SUMMARY OF THE INVENTION

The present invention provides a speaker capable of properly adjusting a spring characteristic with which a voice coil is driven and capable of being driven in large amplitude, and provides a speaker apparatus.

According to a first aspect of the present invention, there is provided a speaker comprising a cylindrical bobbin, a support structure adapted to support the bobbin for sliding motion in an axial direction of the bobbin, a magnetic path formation frame having a magnet and a magnetic path formation member that cooperates with the magnet to form a cylindrical magnetic gap, the bobbin being disposed coaxially with the magnetic gap, and a magnetic field that passes through interior and exterior of the bobbin being formed in the magnetic gap, a control coil wound around the bobbin, and first and second coils wound around one end side and another end side of the bobbin, respectively, with the control coil disposed between the first and second coils, wherein the magnetic field is formed to be opposite in direction between the one end side and the other end side of the control coil, and the magnetic field is formed such that when a constant electric current flows through the control coil, a Lorentz force acts on the control coil in a direction of forcing back the bobbin slidingly moved from a predetermined position.

The control coil can be disposed between magnetic gaps or disposed so as to overlap at both ends thereof the magnetic gaps in which the magnetic field is formed in opposite directions.

According to a second aspect of this invention, there is provided a speaker apparatus comprising the speaker according to the first aspect of this invention, and a circuit adapted to supply the control coil of the speaker with a constant electric current.

The speaker apparatus can include an output unit adapted to amplify an electric current supplied thereto and supply the first and second coils with the amplified electric current in opposite directions.

With the speaker and the speaker apparatus according to the present invention, the spring characteristic with which a voice coil including the bobbin and the like is driven can properly be adjusted and a large amplitude driving can be realized.

Further features of the present invention will become apparent from the following description of an exemplary embodiment and modifications thereof with reference to the attached drawings.

DETAILED DESCRIPTION OF THE PREFERRED EMBODIMENT

The present invention will now be described in detail below with reference to the drawings showing a preferred embodiment thereof.

Figure 1:
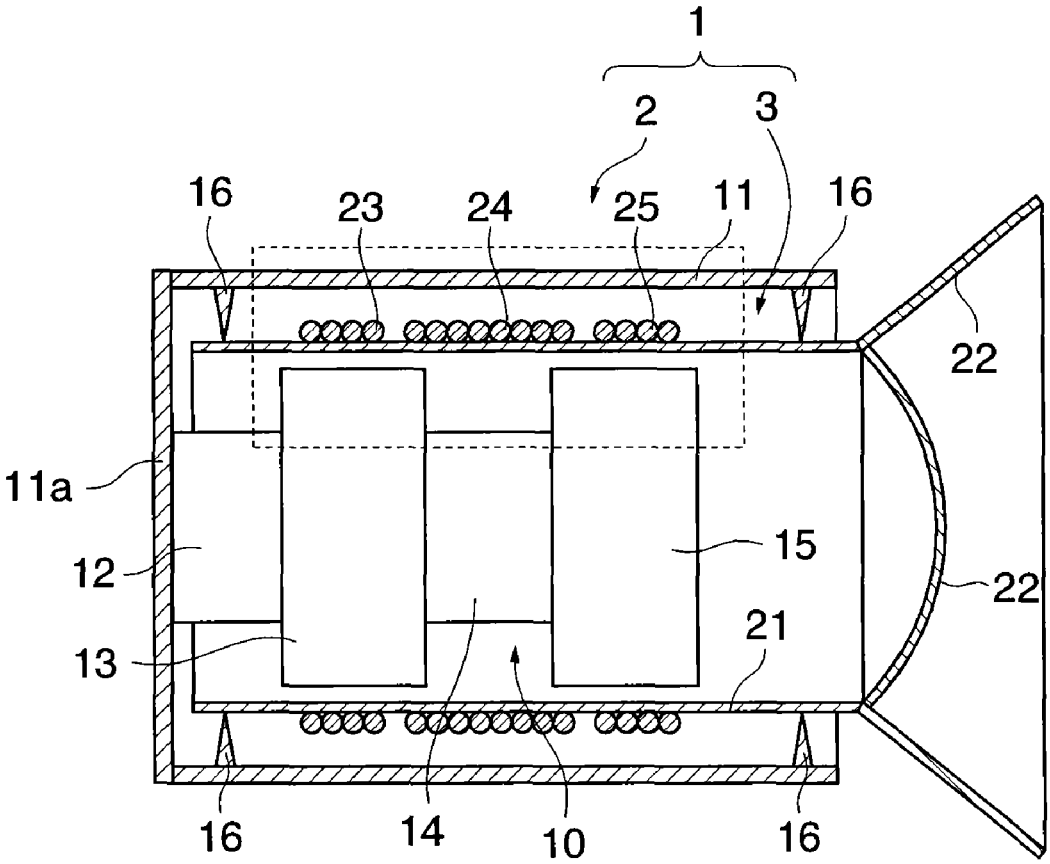
FIG. 1 is a section view of a speaker according to one embodiment of this invention.

FIG. 1 shows the entire construction of a speaker 1 of one embodiment of this invention in a state that a voice coil 3 is at a stationary position (neutral or reference position).

The speaker 1 includes a yoke 2 (housing) and a voice coil 3 disposed for sliding motion relative to the yoke 2 while remaining in contact with the yoke 2.

First, the construction of the yoke 2 is described with reference to FIG. 1. The yoke 2 is comprised of an internal yoke 10 and an external yoke 11. The external yoke 11 is formed by a magnetic material such as iron and into a cylindrical shape having a bottom surface 11*a* thereof disposed on a rear side (left side in FIG. 1) of the speaker 1. The internal yoke 10 has a substantially cylindrical structure and includes a holding part 12 fixed to the bottom surface 11*a* of the external yoke 11, a rear plate 13 adjacent to the holding part 12, a magnet 14 adjacent to the rear plate 13, and a front plate 15 adjacent to the magnet 14.

The magnet 14 is formed by a permanent magnet whose magnetization is maintained without an external magnetic field. The magnet 14 is magnetized into an N pole and an S pole on the front and rear sides thereof (right and left sides in FIG. 1). The front and rear plates 15, 13 are each formed by a paramagnetic material that is magnetized by the magnet 14 in a direction of a magnetic field of the magnet 14, when placed in the magnetic field. Substantially cylindrical air gaps are formed between the external yoke 11 and the front plate 15 and between the external yoke 11 and the rear plate 13. The magnetic field of the magnet 14 is formed by magnetic flux produced from the magnet 14 and concentrated into the air gaps. Hereinafter, the air gaps are referred to as the magnetic gaps.

Figure 3:
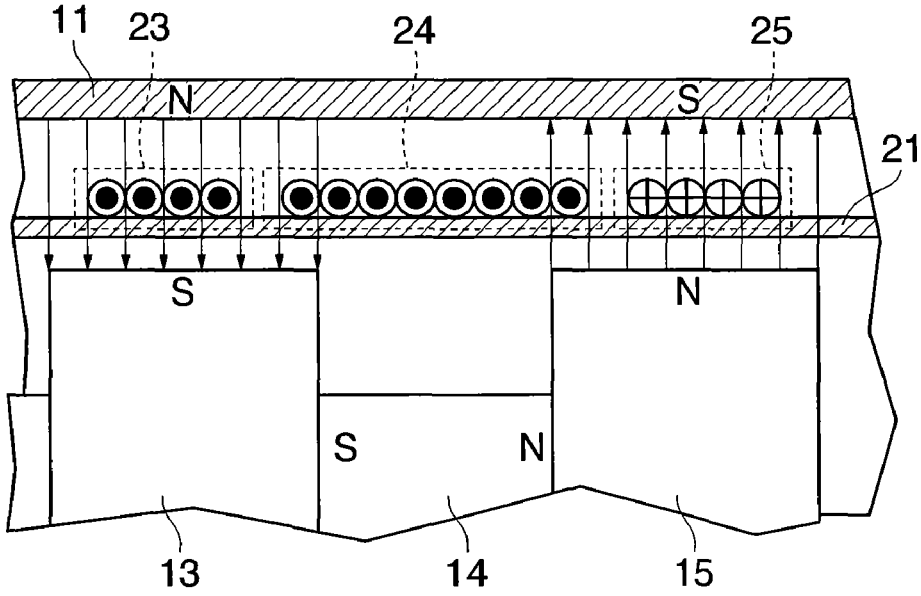
FIG. 3 is an enlarged view showing magnetic gaps.

Since the N and S poles of the magnet 14 are arranged as described above, the magnetic field in the magnetic gap formed circumferentially of the front plate 15 is directed from the front plate 15 to the external yoke 11, whereas the magnetic field in the magnetic gap formed circumferentially of the rear plate 13 is directed from the external yoke 11 to the rear plate 13 (see FIG. 3).

Sliding parts 16 which are triangle in cross section are formed on an inner peripheral surface of the external yoke 11 so as to protrude toward the internal yoke 10, the sliding parts 16 being disposed at predetermined intervals circumferentially of the inner peripheral surface of the external yoke 11. In other words, the sliding parts 16 are disposed radially as viewed from the axis of the external yoke 11.

The voice coil 3 includes a bobbin 21, a diaphragm 22, and coils 23 to 25. The bobbin 21 is formed into a cylindrical shape and disposed coaxially with the cylindrical air gaps between the external yoke 11 and the front and rear plates 15, 13. Thus, the bobbin 21 is fitted into the gap between the external yoke 11 and the internal yoke 10 and supported by the sliding parts 16 so as to be movable in the axial direction of the bobbin 21.

Since the external yoke 11 is contact at the projection tip ends of the sliding parts 16 with the bobbin 21, sliding resistance generated when the bobbin 21 makes a sliding motion relative to the external yoke 11 while remaining in contact therewith is extremely small, and therefore, motion resistance is negligible. In this embodiment, the outer peripheral surface of the bobbin 21 is smoothened (for example, plated) in a region where the bobbin 21 is in contact with the protrusion structure of the sliding parts 16.

The diaphragm 22 is a cone diaphragm and fixed to the front end of the cylindrical bobbin 21. The diaphragm 22 is formed by paper comprised of wood pulp in which various fibers such as carbon fibers are mixed, or comprised of metal such as aluminum, or ceramics, or plastics such as polypropylene.

Coils are wound around the bobbin 21 so as to be integral therewith. In this embodiment, three coils, i.e., the rear coil 23, the position control coil 24, and the front coil 25 are wound around the bobbin 21.

The front coil 25 is wound around the bobbin 21, with its turns close to one another, in a state that front and rear ends thereof are positioned offset axially inward by predetermined lengths from front and rear ends of the front plate 15 when the voice coil 3 is at the reference position as shown in FIG. 1. Similarly, the rear coil 23 is wound around the bobbin 21, with its front and rear ends positioned offset axially inward by predetermined lengths from front and rear ends of the rear plate 13 and with its turns close to one another. The position control coil 24 is wound around the bobbin 21 with its turns close to one another, and is disposed such that it overlaps the entire region of the magnet 14 and overlaps parts of the front plate 15 and the rear plate 13 by the same length.

Figure 2:
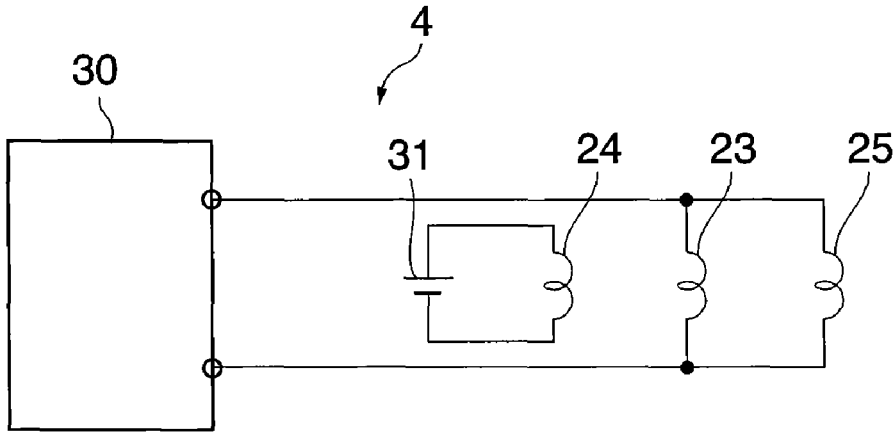
FIG. 2 is a circuit diagram showing a current supply circuit for the speaker.

Next, a circuit 4 for supplying electric current to the rear coil 23, the position control coil 24, and the front coil 25 is described with reference to FIG. 2. The current supply circuit 4 includes an amplifier 30 having output terminals thereof from which an audio signal is supplied to the front and rear coils 25, 23. Thus, an electric current is commonly supplied to the front coil 25 and the rear coil 23.

The current supply circuit 4 includes a DC power source 31 from which a direct current of a given magnitude is supplied to the position control coil 24. The DC power source 31 is implemented by current supply means such as a battery or a constant DC current circuit (for example, switching regulator) for converting commercial power into direct current.

FIG. 3 shows in enlarged scale a region (near the magnetic gaps) surrounded by a dotted line in FIG. 1. In FIG. 3, a cross section of each turn of the rear coil 23, the position control coil 24, and the front coil 25 is shown by a circle with dot or a circle with cross. The circles with dot showing the cross sections of the rear coil 23 indicate that an electric current is supplied from the amplifier 30 to the rear coil 23 in a direction from the rear of the drawing paper of FIG. 3 to the front thereof. The circles with cross showing the cross sections of the front coil 25 indicate that an electric current is supplied to the front coil 25 in a direction from the front of the drawing paper to the rear thereof. That is, the electric currents supplied to the rear and front coils 23, 25 are the same in waveform but opposite in direction. The position control coil 24 is supplied from the DC power source 31 with a direct current flowing from the rear of the drawing paper to the front thereof.

It should be noted that FIG. 3 schematically shows the polarities (directions) of electric currents supplied to the rear coil 23, the position control coil 24, and the front coil 25, but does not accurately show the number and winding density of turns of each coil. Arrows shown across the magnetic gaps represent the directions of magnetic fields formed in the magnetic gaps.

Next, the operation of the speaker 1 having the above described construction will be described.

The following is a description of the operation of the speaker 1 at the time of no audio signal being supplied to the speaker 1. As described above, even when an audio signal is not supplied, a direct current is always supplied to the position control coil 24. When the voice coil 3 is at the reference position as shown in FIG. 1, each end portion of the position control coil 24 crosses the magnetic gap over the predetermined length. Therefore, Lorentz forces resulting from magnetic fields formed in the magnetic gaps always act on the both end portions of the position control coil 24. In the following, characteristics of the Lorentz forces are described.

In accordance with Fleming's left-hand rule, the direction of each of the Lorentz forces is determined based on the direction of the magnetic field in the magnetic gap concerned and the direction of electric current flowing to cross the magnetic field. At the front end portion of the position control coil 24, the Lorentz force acts on the coil 24 in the rearward direction (toward the left in FIG. 1). On the other hand, at the rear end portion of the position control coil 24, the Lorentz force acts on the coil 24 in the forward direction.

Since the length of the position control coil 24 crossing the magnetic gap is the same between the front and rear end portions of the coil 24, the Lorentz forces acting on these portions are opposite in direction but the same in magnitude and therefore balanced with each other.

Figure 4:
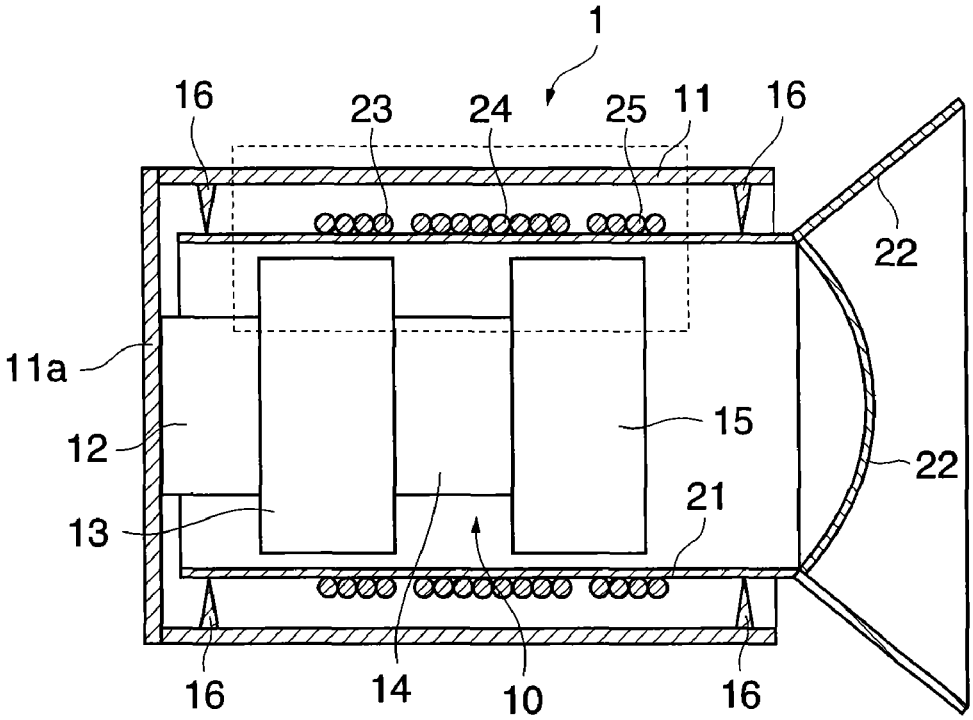
FIG. 4 is a sectional view showing the speaker in a state where a voice coil is displaced from a stationary position.
Figure 5:
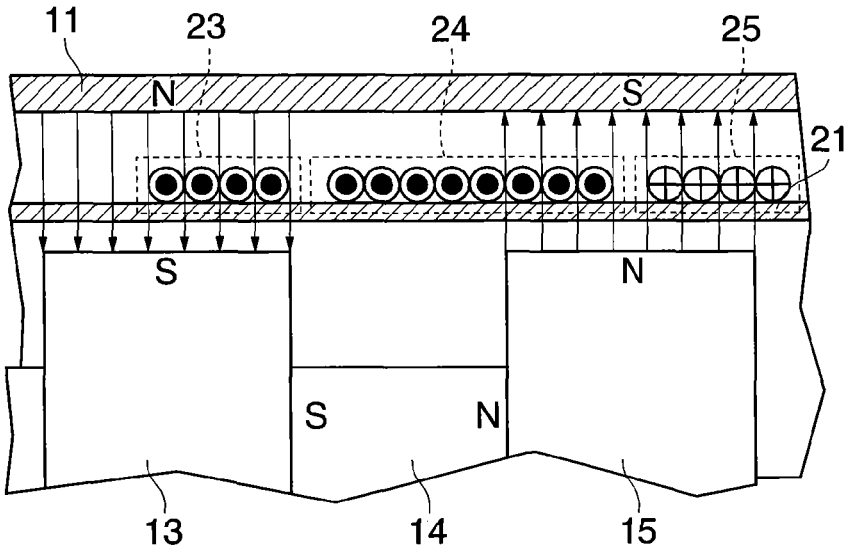
FIG. 5 is an enlarged view showing the magnetic gaps in a state the voice coil is displaced.

Next, Lorentz forces observed when the voice coil 3 is slightly moved forward or rearward are described. FIG. 4 shows the voice coil 3 slightly moved forward from the reference position, and FIG. 5 shows in enlarged scale a region (near the magnetic gaps) surrounded by a dotted line in FIG. 4.

In a state that the voice coil 3 is slightly moved forward, the length of the position control coil 24 crossing the magnetic gap is longer at the front end portion thereof than at the rear end portion thereof. Since the Lorentz force acting on the coil is proportional to the length of the coil crossing the magnetic gap, the force acting on the front end portion of the position control coil 24 (exerting leftward in FIG. 4) is larger than the force acting on the rear end portion thereof (exerting rightward in FIG. 4). Thus, the vector sum of the Lorentz forces acts in the leftward direction, which is opposite from the moving direction of the voice coil 3.

On the other hand, in a state that the voice coil 3 is moved rearward, the sum of the Lorentz forces acts in the direction (forward) opposite from the moving direction of the voice coil 3, for the same reason.

In summary, when the voice coil 3 is moved from the reference position either forward or rearward, the Lorentz force acts on the entire position control coil 24 in the direction opposite from the moving direction of the voice coil 3. As a result, the voice coil 3 is stably maintained at the reference position.

The Lorentz force corresponding to the electric current flowing through the position control coil 24 and acting in the direction opposite from the moving direction of the voice coil 3 will be referred to as the "electric spring force". The electric spring force stably maintains the voice coil 3 at the reference position.

The following is a description of operation at the time of an audio signal being supplied to the speaker 1. In that case, an electric current of a waveform varying in dependence on the audio signal is supplied to the front and rear coils 25, 23. For example, an audio signal representing a tone (pure tone) of 800 Hz is supplied in the form of a sinusoidal alternating current of 800 Hz. The front and rear coils 25, 23 are wound around the bobbin 21 such as to perpendicularly cross the magnetic fields in the magnetic gaps. Therefore, when an electric current is supplied to the front and rear coils 25, 23, Lorentz forces are produced due to the magnetic fields formed in the magnetic gaps. In the following, how the voice coil 3 is driven by the Lorentz forces is described.

Figure 6:
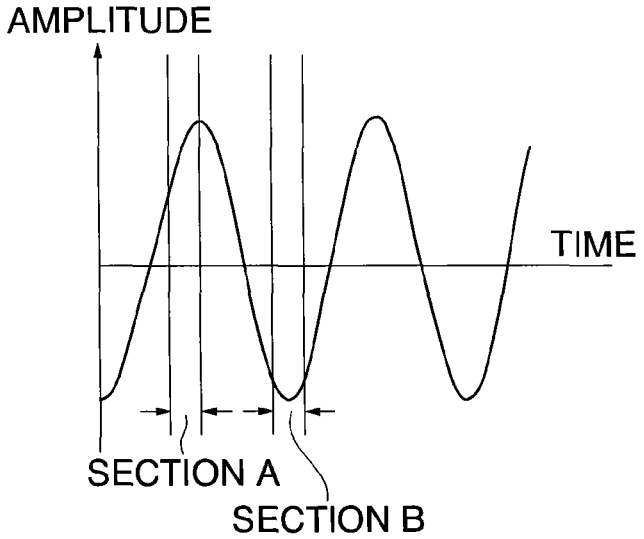
FIG. 6 is a graph of an electric current supplied to front and rear coils.

When, for example, an electric current having a waveform shown in FIG. 6 is supplied to the front and rear coils 25, 23, in a current waveform section A, the electric current flows through the front coil 25 in the direction from the front of the drawing paper to the rear thereof, whereas the electric current flows through the rear coil 23 in the direction from the rear of the drawing paper to the front thereof. The electric currents flowing through the front and rear coils 25, 23 are opposite in direction, and the magnetic fields formed in the magnetic gaps and crossing these coils are also opposite in direction from each other. Therefore, the Lorentz forces acting on the front and rear coils are the same in direction as each other. Thus, both the Lorentz forces act in the forward direction (rightward in FIG. 4), and as a result, the voice coil 3 is driven by the Lorentz forces in the forward direction.

In the current waveform section A, a direct current is supplied to the position control coil 24. Due to the supply of the direct current, a Lorentz force (electric spring force) varying depending on an amount of movement of the voice coil 3 acts in a direction opposite from the moving direction of the voice coil 3. The sum of a driving force based on an audio signal and the electric spring force acts on the entire voice coil 3 being moved. The voice coil 3 is moved to a position where the driving force based on the audio signal is balanced with the electric spring force. Thus in the current waveform section A, the voice coil 3 is moved to a position forward of the reference position.

On the other hand, when the electrical current flows in the negative direction as in a current waveform section B in FIG. 6, both the Lorentz forces acting on the front and rear coils 25, 23 exert in the rearward direction (leftward in FIG. 4), unlike in the section A. With movement of the voice coil 3, the electric spring force exerts in the direction (forward) opposite from the moving direction of the voice coil. As a result, the voice coil 3 is moved to a position rearward of the reference position.

Since the electric current supplied to the front and rear coils 25, 23 is based on the audio waveform, the value of the electric current oscillates. The actions described for the current waveform sections A, B are alternately repeated, and therefore, the voice coil 3 is reciprocated (vibrated) in accordance with the waveform of the audio signal. With the vibration of the voice coil 3, the diaphragm 22 also vibrates in conjunction with the voice coil 3, whereby sound is emitted according to the waveform of the audio signal.

As described above, when supplied with no audio signal, the voice coil 3 is stably maintained at the reference position by the electric spring force acting on the position control coil 24. When supplied with an audio signal, the voice coil 3 is vibrated according to the waveform of the audio signal by the driving force based on the audio signal and the electric spring force produced by the position control coil 24.

To support the voice coil or set the reference position for vibration, a mechanical support member such as an edge or a spider is conventionally employed. In that case, problems of the voice coil vibration being limited and an undesired force being applied to the voice coil are posed due to the material or shape of the support member. On the other hand, according to the technique of this embodiment, the voice coil can be supported at the reference position for vibration and can be vibrated around the reference position at the time of sound emission without the need of using the support member, whereby the above described problems can be solved.

In the above, the embodiment of this invention has been described. This invention can be carried out in various forms as described below. The below-mentioned forms can be embodied in various combinations.

(First Modification)

In the embodiment, an exemplar construction for generating the electric spring force has been described. However, the electric spring force can be controlled by changing the way of winding the position control coil 24, or controlling the direct current value, or controlling the magnetic fields in the magnetic gaps.

Specifically, the winding density of the position control coil 24 around the bobbin 21 can be adjusted as described in the following forms 1A, 1B of the first modification.

(1A) The winding density of the position control coil 24 uniformly wound around the bobbin 21 can be increased. In that case, the electric spring force with the movement of the voice coil 3 becomes larger with increase in the winding density. If, on the other hand, the winding density is made small, the electric spring force becomes small.

(1B) The winding density of the position control coil 24 around the bobbin 21 can be locally increased. In that case, the electric spring force can be controlled in various manners with the movement of the voice coil 3. For example, in a case that the winding density of the position control coil 24 is made high near the center of the winding width and made low at both end portions of the winding width, the electric spring force becomes large with increase of movement of the voice coil 3 to thereby make it difficult for the voice coil 3 to move.

The value of the direct current supplied to the position control coil 24 can be changed, as described in the following forms 1C to 1E of the first modification.

(1C) If the direct current supplied to the position control coil 24 is set to have a large value, the electric spring force becomes large. On the other hand, if the direct current is set to be small, the electric spring force becomes small.

Figure 7:
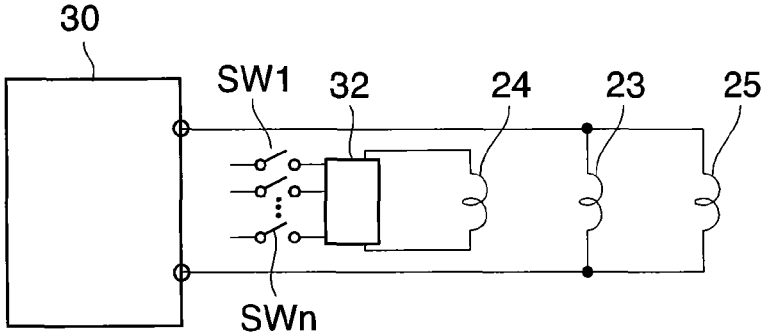
FIG. 7 is a diagram showing one form of direct current supply according to a first modification of the embodiment.
Figure 8:
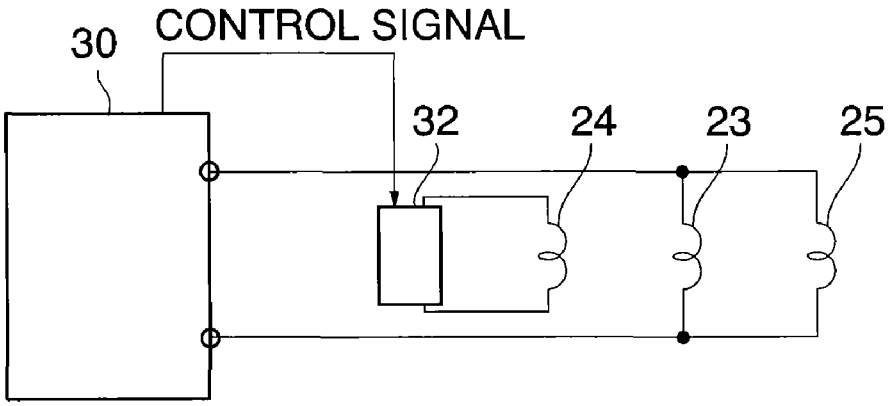
FIG. 8 is a diagram showing another form of direct current supply in the first modification.

(1D) The direct current supplied to the position control coil 24 can be set to a value different between types of music piece or between types of acoustic space, whereby sound of acoustic characteristics suitable to circumstance can be emitted. For example, among from output values of a variable output DC power source 32 shown in FIG. 7, a desired output value may be selected by means of switches SW1 to SWn. Alternatively, as shown in FIG. 8, the amplifier 30 may have an additional function of outputting a control signal to instruct the DC power source 32 to change the output value in accordance with the control signal. In that case, the amplifier 30 may be provided with a selection switch by means of which the content of the control signal is changed. Alternatively, the amplifier 30 may have a function of automatically identifying a type of music piece (for example, by means of processing to identify the genre based on range detection or beat detection) or a type of acoustic space based on a result of analysis of audio signal or based on a signal from audio signal output equipment (external equipment), and in accordance with the identified type of music piece or acoustic space, the control signal may be output.

(1E) To change the strength of the magnetic fields in the magnetic gaps, the magnet 14 may be replaced, or the distance between the magnetic gaps or the magnitude of the magnetic gaps may be changed.

As described by way of example in the above, the desired form of electric spring force can be set by the user. By the above electric setting of the spring characteristic, it is possible to realize acoustic effects which are difficult to be realized by the mechanical support member.

(Second Modification)

In the embodiment, the position control coil 24 is stably held at the reference position by winding the coil 24 around the voice coil 3 such that the length of the coil 24 crossing the magnetic gaps is the same between the both ends thereof. However, the way of winding the position control coil 24 and the way of supplying the direct current are not limited to those in the embodiment. The position control coil 24 can stably be held at the reference position by means of the following forms 2A to 2C of the second modification.

Figure 9:
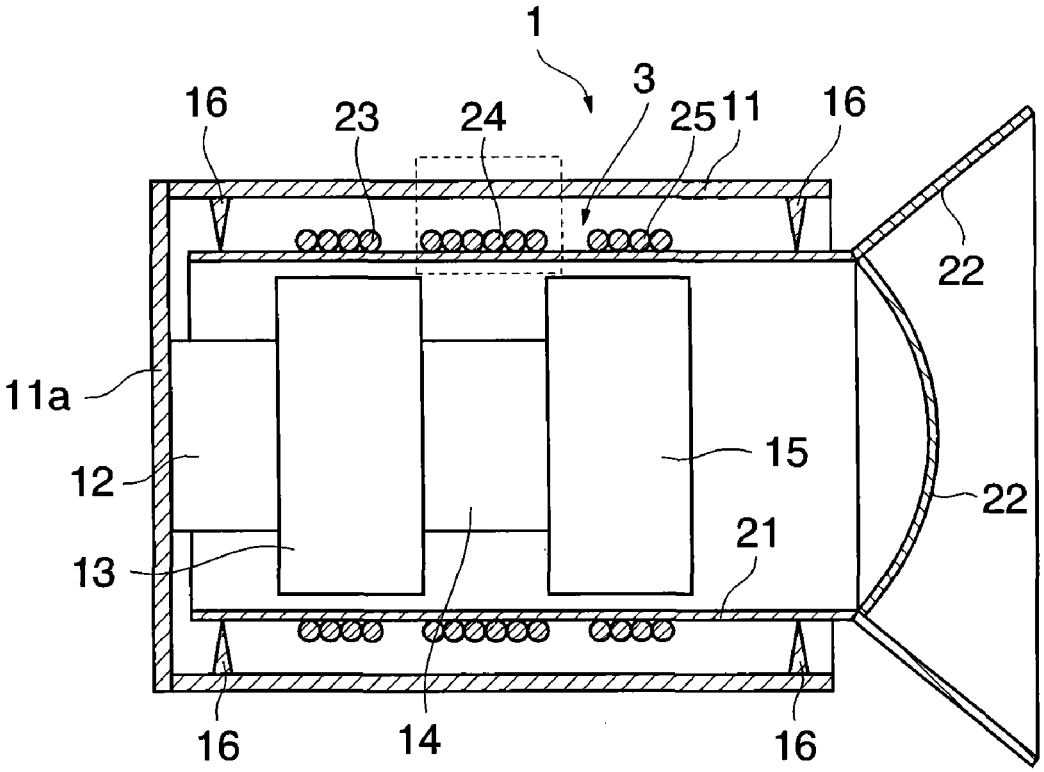
FIG. 9 is a section view showing a speaker according to one form of a second modification of the embodiment.

(2A) For example, the position control coil 24 may have a winding width extending between the rear end of the front plate 15 and the front end of the rear plate 13 so that the coil 24 overlaps neither of the magnetic gaps, as shown in FIG. 9. In that case, the electric current is made to flow through the position control coil 24 in the direction from the rear of the drawing paper to the front thereof in a region surrounded by the dotted line in FIG. 9. When the voice coil 3 is at the reference position, the position control coil 24 crosses neither of the magnetic gaps, and therefore, the voice coil 3 is not applied with Lorentz forces. When the voice coil 3 moves in the forward direction, the front end of the position control coil 24 crosses the magnetic gap. As a result, a Lorentz force acts on that portion of the position control coil 24 which crosses the magnetic gap, and the voice coil 3 is applied with the force exerting in the direction (rearward) opposite to the moving direction of the voice coil 3. When the voice coil 3 moves in the rearward direction, a Lorentz force exerting in the forward direction is applied to the voice coil 3. With the form 2A of the second modification, the voice coil 3 is stably held at the reference position, as in the embodiment.

Figure 10:
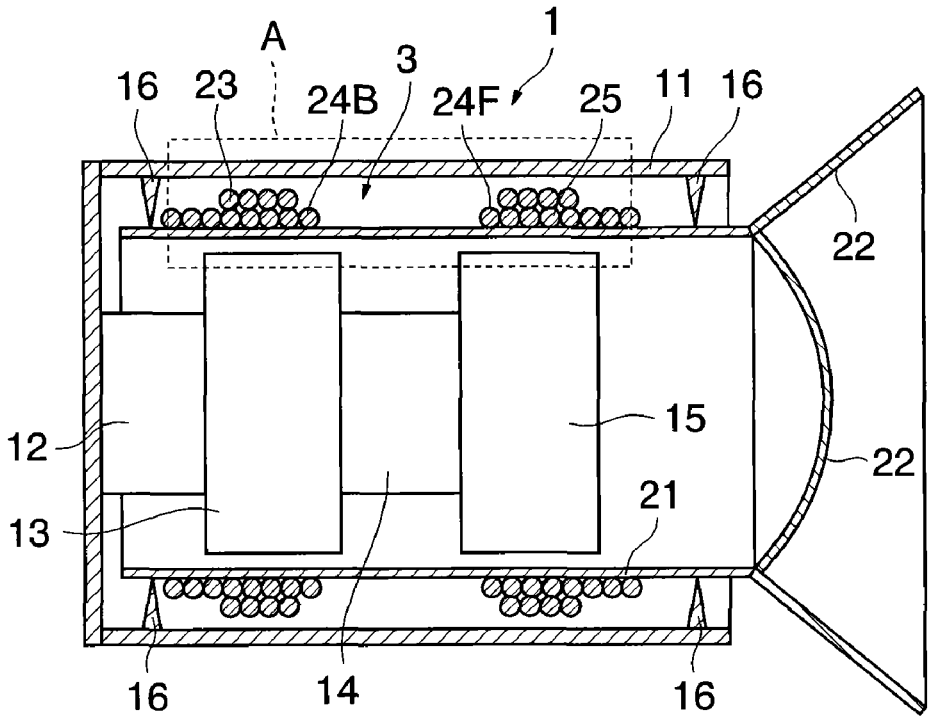
FIG. 10 is a section view showing a speaker according to another form of the second modification.

(2B) As shown in FIG. 10, two position control coils 24 may be provided (which are distinctively denoted by different numerals 24B, 24F). Specifically, the position control coil 24F may be wound around the voice coil 3 such that both ends of the coil 24F are displaced forwardly relative to both ends of the magnetic gap formed circumferentially of the front plate 15, whereas the other position control coil 24B may be wound such that both ends thereof are displaced rearwardly relative to both ends of the magnetic gap formed circumferentially of the rear plate 13. In that case, the DC power source 31 may be adapted to supply the position control coil 24 with a direct current flowing therethrough in a direction from the front of the drawing paper to the rear thereof in a region A surrounded by a dotted line in FIG. 10.

It is apparent that when the voice coil 3 is at the reference position shown in FIG. 10, the vector sum of Lorentz forces acting on the position control coils 24B, 24F is equal to zero, though a description is omitted.

Figure 11:
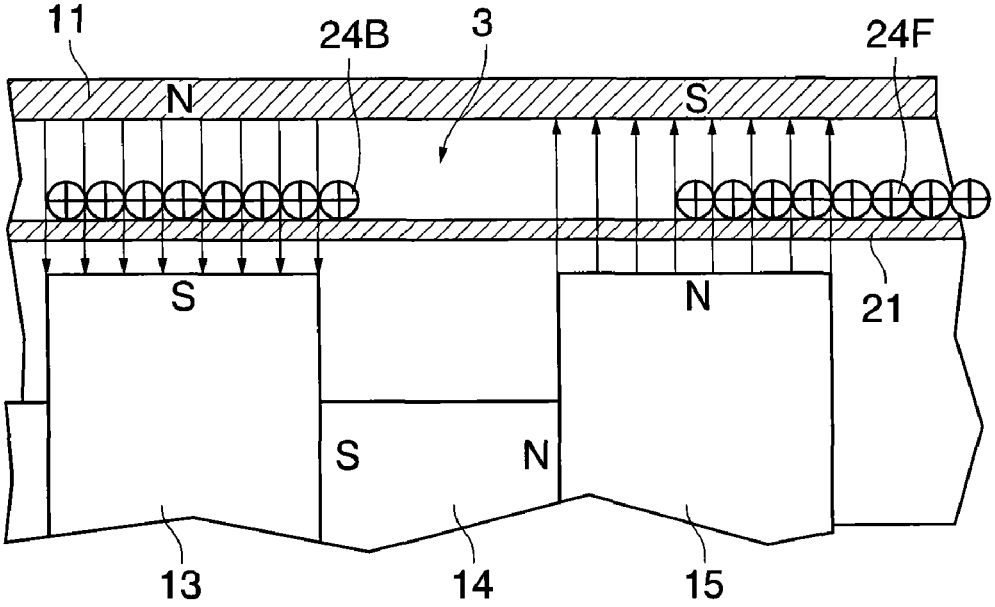
FIG. 11 is an enlarged view showing magnetic gaps in the speaker shown in FIG. 10.

The following is a description of Lorentz forces acting on the voice coil 3 that is moving in the forward direction. FIG. 11 shows a positional relation between the position control coils 24B, 24F and the magnetic gaps observed when the voice coil 3 shown in FIG. 10 is moving forward. Illustrations of the front and rear coils 25, 23 are omitted in FIG. 11.

At this time, a forward Lorentz force acts on the position control coil 24F and a rearward Lorentz force acts on the position control coil 24B. Since the length of the position control coil 24B crossing the magnetic gap is larger than the length of the position control coil 24F crossing the other magnetic gap, the Lorentz force acting on the coil 24B is larger than the Lorentz force acting on the coil 24F. As a result, the vector sum of the Lorentz forces acting on the position control coils 24 exerts in the rearward direction (leftward in FIG. 11) opposite from the moving direction of the voice coil 3.

Though a description is omitted, when the voice coil 3 moves rearward, the Lorentz force exerts in the direction (forward) opposite from the moving direction of the voice coil.

As described above, the voice coil 3 is stably held at the reference position also in the form 2B of the second modification.

Figure 12:
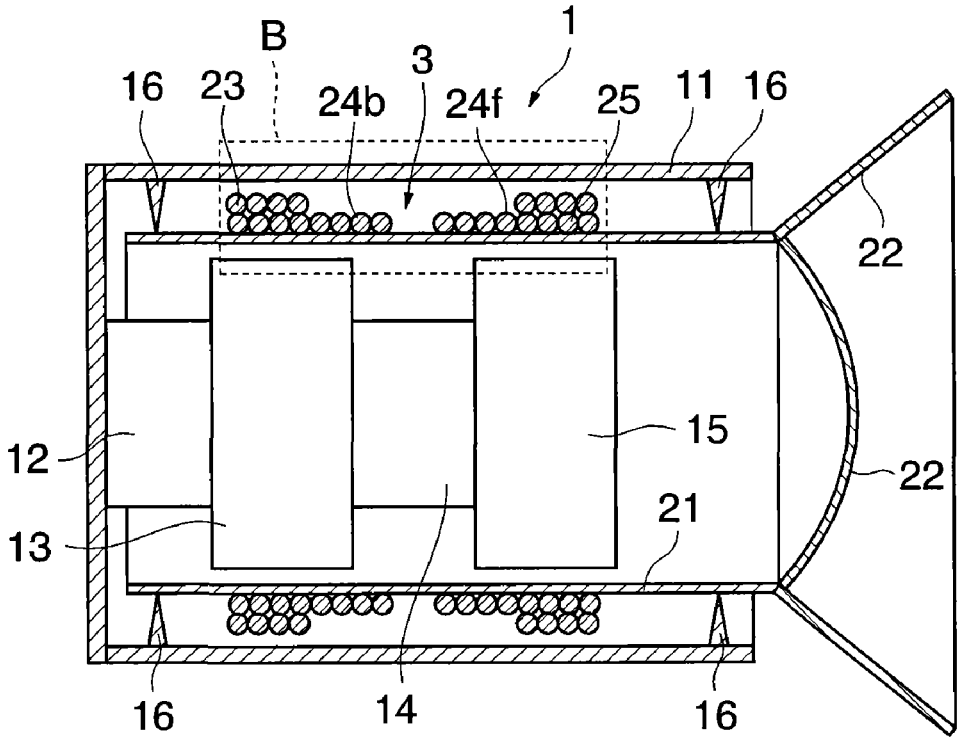
FIG. 12 is a section view showing a speaker according to still another form of the second modification.

(2C) As shown in FIG. 12, two position control coils 24 (which are distinctively denoted by reference numerals 24*b*, 24*f*) may be provided. The position control coil 24*f* is wound around the voice coil 3 from a position offset rearward by a predetermined length from the front end of the magnetic gap formed circumferentially of the front plate 15 to a position offset rearward from the rear end of the magnetic gap. The position control coil 24*b* may be wound in symmetric with the position control coil 24*f*. In that case, the direct current is supplied to the position control coils 24 in the direction from the rear of the drawing paper to the front thereof in a region B surrounded by the dotted line in FIG. 12.

Though a description is omitted, when the voice coil 3 is at the reference position in FIG. 12, the sum of Lorentz forces acting on the position control coils 24*b*, 24*f* is equal to zero.

Figure 13:
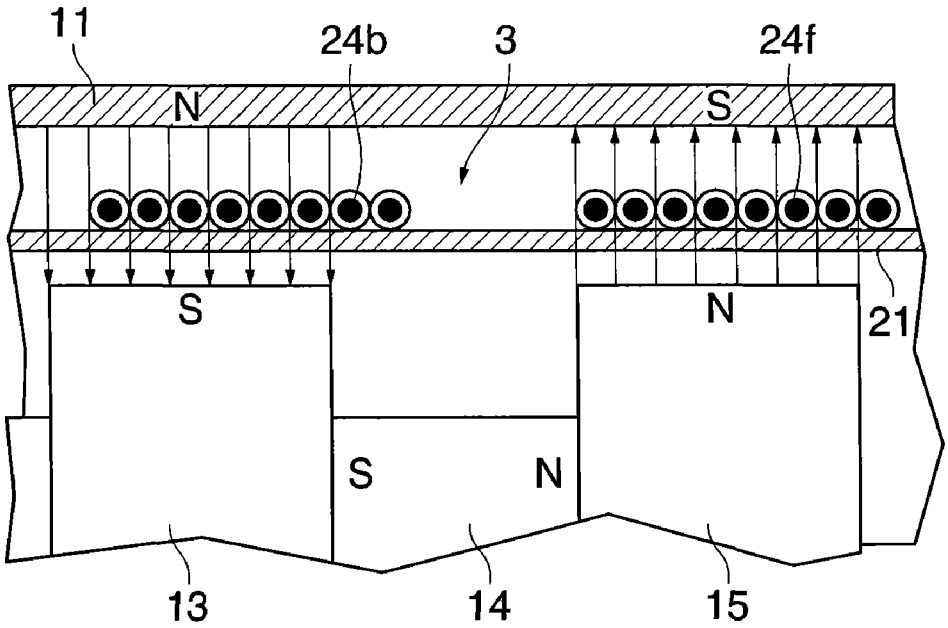
FIG. 13 is an enlarged view showing magnetic gaps in the speaker shown in FIG. 12.

The following is a description of Lorentz forces acting on the voice coil 3 that is moving in the forward direction. FIG. 13 shows a positional relation between the position control coils 24 and the magnetic gaps when the voice coil 3 shown in FIG. 12 is moving forward. Illustration of the front and rear coils 25, 23 is omitted in FIG. 13.

When the voice coil 3 is moving forward, a rearward Lorentz force acts on the position control coil 24*f* and a forward Lorentz force acts on the position control coil 24*b*. Since the length of the coil 24*f* crossing the magnetic gap is larger than the length of the coil 24*b* crossing the other magnetic gap, the Lorentz force acting on the coil 24*f* is larger than the Lorentz force acting on the coil 24*b*. As a result, the vector sum of the Lorentz forces acts on the position control coils 24 in the direction (leftward in FIGS. 12 and 13) opposite to the moving direction of the voice coil 3.

Though a description is omitted, when the voice coil 3 is moving in the rearward direction, the vector sum of the Lorentz forces exerts in the direction (forward) opposite from the moving direction of the voice coil.

Also in the form 2C of the second modification, the voice coil 3 is stably retained at the reference position.

In any of the forms 2A to 2C of the second modification, when the voice coil 3 is at the reference position, no Lorentz forces act on the position control coils 24 to which an electric current is being supplied. Even if Lorentz forces act on the coils 24, the vector sum of the Lorentz forces is equal to zero. When the voice coil 3 is slightly displaced forward or rearward from the reference position, portions of the position control coils 24 crossing the magnetic gaps formed circumferentially of the front and rear plates 15, 13 vary, and the vector sum of the Lorentz forces acting on the position control coils 24 is exerted in the direction opposite from the moving direction of the position control coils 24. Thus, the voice coil 3 is stably held at the reference position.

As described above, there are various ways of winding the position control coils 24 and supplying the direct current. However, it is enough to supply the direct current to the position control coils 24 such that the vector sum of Lorentz forces acting on the coils 24 becomes equal to zero when the voice coil 3 is at the reference position and the vector sum of Lorentz forces acting on the position control coils 24 acts in the direction opposite to the moving direction of the voice coil 3 when the voice coil 3 moves either in the forward or rearward direction.

(Third Modification)

In the embodiment, sliding parts 16 of projection structure are provided as a support structure that supports the voice coil 3 for sliding motion inside the external yoke 11. However, the support structure is not limited to that of the embodiment. The following is a description of forms 3A to 3C of a third modification, in which examples of the support structure are shown.

(3A) Support Structure Using Magnetic Fluid

Figure 14:
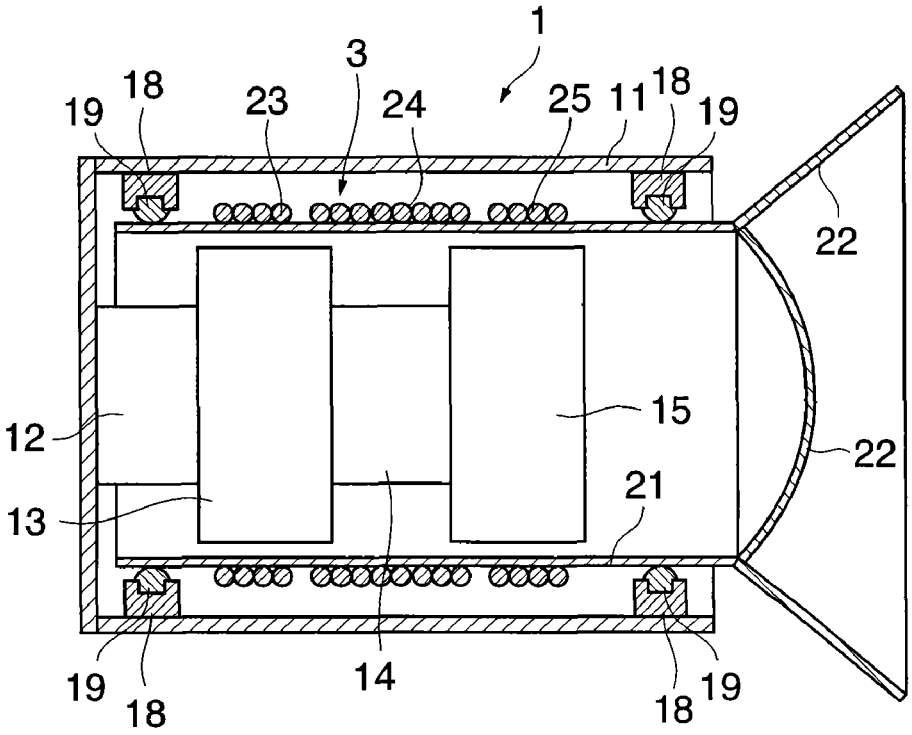
FIG. 14 is a section view showing a speaker according to one form of a third modification of the embodiment, which is provided with a support structure in which magnetic fluid is used.

FIG. 14 shows in cross section a speaker 1 having a support structure in which magnetic fluid is used. The magnetic fluid comprises a medium solution in which fine magnetic particles having surfaces thereof processed with interfacial active agent are suspended.

The external yoke 11 is formed at its inner peripheral surface with a recess structure 18 formed by a magnet. A magnetic fluid 19 poured into a recess in the recess structure 18 is held in the recess with fluidity.

The bobbin 21 is formed by a non-magnetic material and has a smooth surface thereof. The bobbin 21 is fitted to the inner peripheral surface of the external yoke 11 in a state that the bobbin 21 is held at its outer peripheral surface inside the external yoke 11 via the magnetic fluid 19. That is, the voice coil 3 is held by the magnetic fluid 19 in a floating state. When the voice coil 3 vibrates as described in the embodiment, the magnetic fluid 19 is magnetically attracted by the magnet of the recess structure 18, and remains held inside the recess of the recess structure 18.

As described above, since the voice coil 3 is held inside the external yoke 11 via the magnetic fluid 19, a contact resistance produced when the voice coil 3 vibrates in the external yoke 11 can be suppressed to be small. The external yoke 11 and the voice coil 3 are not in direct contact with each other at the time of relative sliding motion, and therefore, wear of contact portions therebetween is not caused.

It should be noted that fluidity resistance of the magnetic fluid 19 may be varied to thereby adjust the resistance between the voice coil 3 and the external yoke 11. To this end, characteristics of the magnetic fluid can be adjusted by varying chemical compositions of the interfacial active agent and/or the medium liquid used for production of the magnetic fluid 19.

(3B) Support Structure Using Bearings

Figure 15:
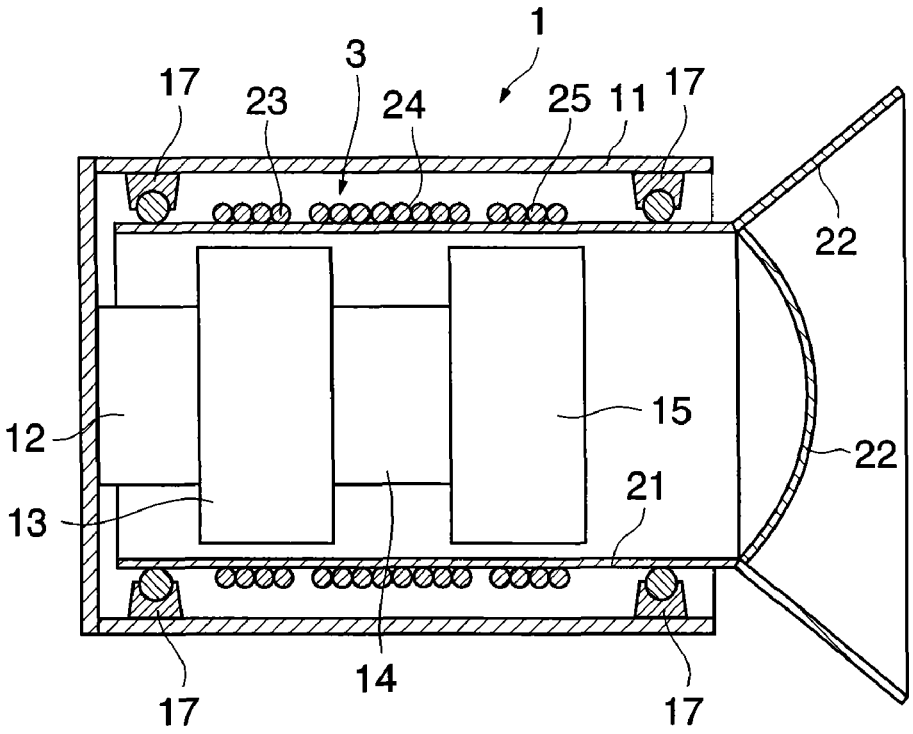
FIG. 15 is a section view showing a speaker according to another form of the third modification, which is provided with a support structure in which bearings are used.
Figure 16:
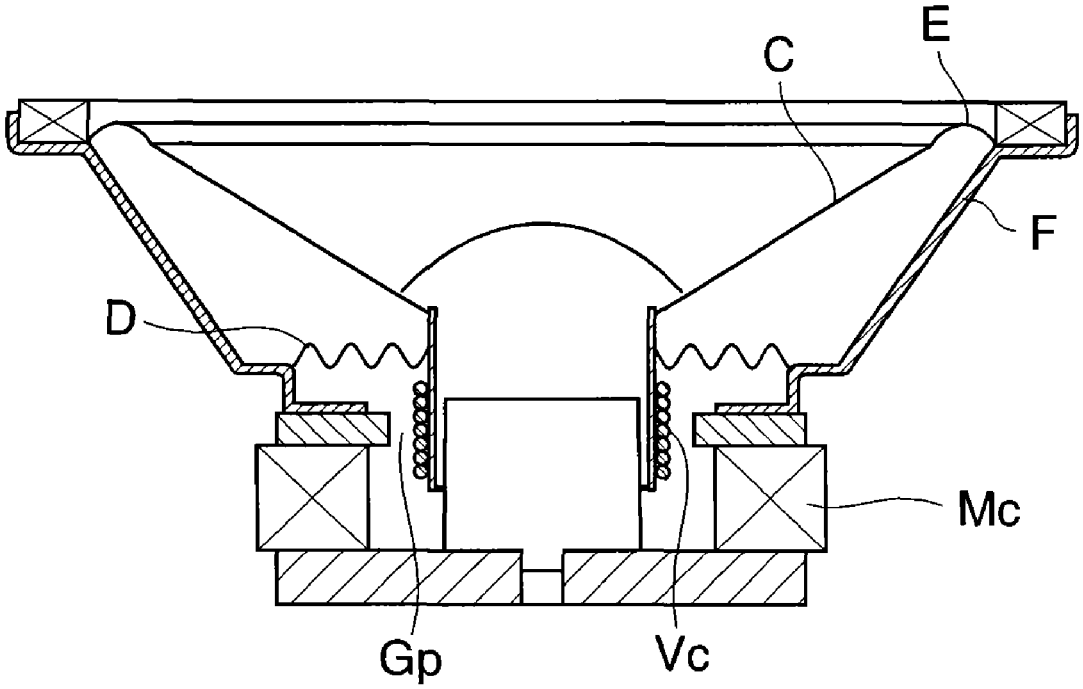
FIG. 16 is a view showing the construction of a conventional moving coil type speaker.

FIG. 15 shows in cross section a speaker 1 having a support structure in which bearings are used.

The external yoke 11 is provided at its inner peripheral surface with conventional ball bearing structures 17. The outer peripheral surface of the bobbin 21 is processed to be smooth by, for example, plating, and the bobbin 21 is fitted to the bearing structures 17 disposed inside the external yoke 11, whereby the bobbin 21 is held inside the external yoke 11 via the ball bearing structures 17. When the voice coil 3 vibrates as described in the embodiment, the voice coil 3 makes a smooth sliding motion relative to the yoke 2. The external yoke 11 and the voice coil 3 are disposed in indirect contact with each other via the ball bearing structures 17, whereby a problem such as wear of contact portions therebetween can be eliminated.

(3C) Support Structure with Damper

A speaker according to the form 3C of the third modification is the same in construction as the conventional speaker except for the mechanical characteristic of the edge of the speaker.

The conventional speaker includes the edge constituted by fiber, urethane foam, or other material. In the form 3C of the third modification, even if the voice coil 3 is held by a support member constituted by such a material, a support member of extremely low elasticity may be used. For example, the support member may be thin in thickness or may be fabricated by a material of low strength. With such a support member, the spring characteristic of the support member can be prevented from largely affecting the drive of the voice coil 3.

(Fourth Modification)

In the embodiment, the amplifier 30 and the DC power source 31 are fabricated separately from the speaker 1. However, the speaker 1 and the DC power source 31 may be combined together and incorporated into a common speaker enclosure or the like. In that case, the DC power source 31 may be disposed in the amplifier 30. That is, a constant DC power source may be incorporated into a circuit of the amplifier 30.

(Fifth Modification)

The sliding parts 16 described in the embodiment are provided on the inner peripheral surface of the external yoke 11. However, the sliding parts 16 may be provided on the outer peripheral surface of the bobbin 21.

What is claimed is:

1. A speaker comprising:

a cylindrical bobbin;

a support structure adapted to support said bobbin for sliding motion in an axial direction of said bobbin;

a magnetic path formation frame having a magnet and a magnetic path formation member that cooperates with the magnet to form a cylindrical magnetic gap, said bobbin being disposed coaxially with the magnetic gap, and a magnetic field that passes through interior and exterior of said bobbin being formed in the magnetic gap;

a control coil wound around said bobbin; and first and second coils wound around one end side and another end side of said bobbin, respectively, with said control coil disposed between said first and second coils, wherein the magnetic field is formed to be opposite in direction between the one end side and the other end side of said control coil, and the magnetic field is formed such that when a constant electric current flows through said control coil, a Lorentz force acts on said control coil in a direction of forcing back said bobbin slidingly moved from a predetermined position.

2. The speaker according to claim 1, wherein said control coil is disposed between magnetic gaps in which the magnetic field is formed in opposite directions.

3. The speaker according to claim 1, wherein said control coil is disposed so as to overlap at both ends thereof magnetic gaps in which the magnetic filed is formed in opposite directions.

4. A speaker apparatus, comprising:

a speaker having a cylindrical bobbin and a control coil wound around the bobbin; and a circuit adapted to supply said control coil with a constant electric current, wherein said speaker includes a support structure adapted to support said bobbin for sliding motion in an axial direction of said bobbin; a magnetic path formation frame having a magnet and a magnetic path formation member that cooperates with the magnet to form a cylindrical magnetic gap, said bobbin being disposed coaxially with the magnetic gap, and a magnetic field that passes through interior and exterior of said bobbin being formed in the magnetic gap; and first and second coils wound around one end side and another end side of said bobbin, respectively, with said control coil disposed between said first and second coils, the magnetic field is formed to be opposite in direction between the one end side and the other end side of said control coil, and the magnetic field is formed such that when a constant electric current flows through said control coil, a Lorentz force acts on said control coil in a direction of forcing back said bobbin slidingly moved from a predetermined position.

5. The speaker apparatus according to claim 4, wherein said control coil is disposed between magnetic gaps in which the magnetic field is formed in opposite directions.

6. The speaker apparatus according to claim 4, wherein said control coil is disposed so as to overlap at both ends thereof magnetic gaps in which the magnetic filed is formed in opposite directions.

7. The speaker apparatus according to claim 4, further including:

an output unit adapted to amplify an electric current supplied thereto and to supply said first and second coils with the amplified electric current in opposite directions.

* * * * *